US005803280A

United States Patent [19]

Mende et al.

[11] Patent Number: 5,803,280

[45] Date of Patent: Sep. 8, 1998

[54] LIFTING AND TRANSPORT APPARATUS FOR TRANSCONTAINERS

[75] Inventors: Burkhard Mende; Andreas Baumann, both of Essen, Germany

[73] Assignee: Krupp Fordertechnik GmbH, Duisburg, Germany

[21] Appl. No.: 743,106

[22] Filed: Nov. 4, 1996

Related U.S. Application Data

[63] Continuation of Ser. No. 374,793, filed as PCT/EP94/01620 May 19, 1994, abandoned.

[30] Foreign Application Priority Data

Jun. 3, 1993 [DE] Germany ..... 43 18 461.8

[51] Int. Cl.[6] ..... B66C 19/00

[52] U.S. Cl. ..... 212/330; 212/316; 212/319; 294/81.21; 294/81.54; 294/81.56

[58] Field of Search ..... 212/314, 316, 212/318, 319, 326, 345, 346, 330; 294/81.21, 81.54, 81.56; 414/460, 392

[56] References Cited

U.S. PATENT DOCUMENTS

| | | | |
|---|---|---|---|
| 1,714,945 | 5/1929 | Buhl | 212/319 |
| 2,349,389 | 5/1944 | Thompson | 212/71 |
| 3,241,686 | 3/1966 | Hurst | 212/319 |
| 3,396,858 | 8/1968 | Baker et al. . | |
| 3,448,874 | 6/1969 | Martinson | 214/75 |
| 3,558,172 | 1/1971 | Lamer et al. | 212/326 |
| 3,759,409 | 9/1973 | Wenzel et al. | 414/460 |
| 3,762,754 | 10/1973 | Goyarts | 294/81.54 |
| 3,773,185 | 11/1973 | Johnson et al. | 212/316 |
| 3,784,028 | 1/1974 | Stewart . | |
| 3,828,954 | 8/1974 | van der Lely et al. | 414/460 |
| 3,945,673 | 3/1976 | Visser | 294/81.54 |
| 4,433,952 | 2/1984 | Glickman | 212/316 |
| 4,789,194 | 12/1988 | Watson | 294/81.54 |
| 5,415,517 | 5/1995 | Lanigan et al. | 212/316 |

FOREIGN PATENT DOCUMENTS

| | | | |
|---|---|---|---|
| 290 785 | 10/1970 | Austria . | |
| 0 025 105 | 3/1981 | European Pat. Off. . | |
| 249 254 | 7/1912 | Germany . | |
| 1 293 433 | 4/1969 | Germany . | |
| 1506503 | 7/1969 | Germany | 212/316 |
| 1756052 | 8/1970 | Germany | 212/316 |
| 7 011 111 | 2/1972 | Netherlands . | |
| 1 098 906 | 1/1968 | United Kingdom . | |
| 1173010 | 12/1969 | United Kingdom | 414/392 |

*Primary Examiner*—Thomas J. Brahan
*Attorney, Agent, or Firm*—Herbert Dubno; Yuri Kateshov

[57] ABSTRACT

A lifting and transport apparatus for containers has a fixed rigid horizontal beam on the lower flange of which two wheeled carriages are displaceable either together or separately to allow, in the latter case, a change in the distance between the carriages and, in the former case, displacement of the container. A cross beam on each of the carriages can carry at its ends fixed columns which guide respective lifting elements having claws at their ends engageable with the container. The entire assembly is free from cables or the like which can introduce sway.

3 Claims, 6 Drawing Sheets

LIFTING AND TRANSPORT APPARATUS FOR TRANSCONTAINERS

CROSS REFERENCE TO RELATED APPLICATION

This is a file-wrapper continuation of application Ser. No. 08/374,793 filed 25 Jan. 1995, now abandoned.

This application is a national phase of PCT/EP94/01620 filed 19 May 1994 and based, in turn, upon German National application P 43 18 461.8 of 3 June 1993 under the International Convention.

FIELD OF THE INVENTION

Our present invention relates to an apparatus movably attached to a beam for lifting and transporting transcontainers of a variety of overall dimensions and including an adjustment means for adapting the spacing of the attachment elements to the spacing of the load suspension points on the transcontainers.

BACKGROUND OF THE INVENTION

Transcontainers include freight containers, interchangeable containers and semi-trailers, that is to say freight containers which are intended in particular for non-packed or only lightly packed moisture sensitive goods or for the formation of larger freight units. Such transcontainers not only save packaging but also increase the transloading rate. The aforesaid transcontainers differ in size for which reason the lifting and transloading apparatus for such transcontainers including their load accommodating and transporting means must be of flexible design.

Grappling apparatus for container transloading is known and can be referred to as spreaders and which can be equipped with additional interchangeable pallet grapplers for accommodating interchangeable containers and semi-trailers. For accommodating freight containers the spreaders are equipped with so-called twist locks by means of which the containers can be gripped from above. For accommodating interchangeable containers and semi-trailers gripping claws are provided which can engage into the grab rebates provided at the underside of the aforesaid containers. The adjustment of the twist locks to the various lengths of the containers is effected in the spreader by telescopic means which, in their extended condition are subjected to high bending loads. After the twist locks have engaged the load suspension points of the container or the claws have engaged the grab recesses of the interchangeable containers or semi-trailers, these are lifted by way of lifting ropes jointly with the entire lifting and transporting means. The lifting ropes are guided over deflecting pulleys fitted on top of the lifting and transporting means. The required short transloading times often result in the lifting and the horizontal movements causing the transcontainers to be set into pendulum motion, preventing an absolutely accurate guiding and setting down. This problem has not been solved adequately even by state of the art pendulum damping means.

Systems are known in storage technology in which a lifting mechanism is arranged movably to the load bearing ropes to which the spreader is fixed. In order to transfer the transcontainer, the latter is slightly raised and displaced by travelling of the engaged lifting mechanism. The twist locks fitted to the top for receiving the containers as well as the deflecting pulleys necessitate a large construction height. In addition, the laterally fitted load bearing arms of the pallet grapplers must be pivoted upwardly when a container is transferred and subsequently must be strung out and hooked on again for accommodating interchangeable containers or semi-tilers, causing the construction of the spreader to be expensive.

OBJECT OF THE INVENTION

It is an object of the present invention to improve the apparatus of the aforesaid type such that the structural height is as low as possible, that the construction is simplified and the apparatus permits, in a simple and reliable manner, a transloading of transcontainers such as freight containers, interchangeable containers or semi-trailers without pendulum movement.

SUMMARY OF THE INVENTION

This object is attained with the apparatus of the invention in that on each side of a lifting vehicle movable on the beam two vertical guide columns mutually adjustably spaced apart, including lifting elements are provided which at their lower free end comprise an attachment element. By this construction the lifting vehicle and the four guide columns are combined into a frame-like structure such that pendulum movements are avoided from the outset. On the other hand, the guide columns and the attachment elements thereof are each so adjustable that all loading units normally arising in a freight loading traffic can be gripped. Because of the lifting elements in the guide columns the provision of superstructures above the lifting vehicle is dispensed with, so that the structural height as a whole can be reduced. Due to the uniform apparatus, that is to say the guide columns including the lifting elements, it is possible to dispense with different gripping elements hitherto provided on the one hand in the form of twist locks and on the other hand in the form of pivotal gripping arms. By the elimination of the hitherto required spreaders, the weight is also reduced. The lifting vehicle may be equipped with an optional number of wheels so that the axle load can in each case be kept low.

The distance between the mutually opposing guide columns is likewise adjustable, for example by way of a sliding means provided in a transverse beam on the lifting vehicle. The distance variability on the one hand makes it possible to dispense with additional pivoting or sliding means for the fixing means, since the fixing means jointly with the guide columns are movable in relation to the transcontainer. The moving towards one another of the mutually opposing guide columns causes the attachment elements with the load suspension points of the containers or the gripping recesses of the interchangeable containers or semi-trailers to be brought into engagement or into the engagement position and likewise to be released again by their moving apart. On the other hand this also makes it possible to accommodate transcontainers not only of different lengths but also of different widths.

Preferably the lifting vehicle is suspended from the lower flange of a beam so as to be movable, for example, in a high level shelf store. The beams are formed preferably of I section or even of channel profiles so that, for example, transcontainers of appropriate widths can be deposited on the upper flanges of the beams of the depositing plane of a shelf store therebelow. A beam may accordingly serve both with its upper flange as a depositing plane but also with its lower flange as a running track for a lifting vehicle forming part of the plane therebelow.

The attachment element can be brought into engagement with the lower load suspension means of the containers as well as with the gripping recesses of the interchangeable containers and semi-trailers. For that purpose the attachment element is equipped with a claw for the gripping recesses in which, at right angles thereto movable in the direction of its longitudinal axis, an irrotationally secured bolt is provided which is kept by a spring in its normal position, i.e. its extended position.

The attachment elements are brought into their engagement position after the positioning of the lifting vehicle by reducing the spacing apart of the mutually opposing guide columns. This, in the case of a container, causes the bolts to enter-into the elongate holes of the load suspension points. A slipping off by the container is prevented by two projections provided at the front end of the bolts which, when lifting the container, engage behind the elongate holes.

In the case of an interchangeable container or a semi-trailer, the moving towards one another of the guide columns first causes the bolt to enter into an abutting position. It is pushed back against its spring bias until the claw enters into an abutting position so as to be able to grip into the gripping recess when being lifted.

According to a further feature of the invention the lifting vehicle is formed of two half-carriages each of which is suspended on or from a beam and which are adapted to move in relation to one another viewed in the direction of transporting. Accordingly, the half-carriages can be moved jointly or independently from one another into the position in which a gripping engagement of the attachment elements to the transcontainer on both sides is possible.

In order to reduce the axle loads, the lifting vehicle or the half-carriages are supported on a plurality of running wheels.

The separate controllability of the lifting drive means permits picking up even inclined load units. In order to lift the containers, the lifting drive means are controlled in synchronisation. In the case of two half-carriages their drive means are likewise adapted to be controlled separately to permit their positioning in accordance with the size of the container or the position of the load suspension points. For horizontal transport they are controlled synchronously.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
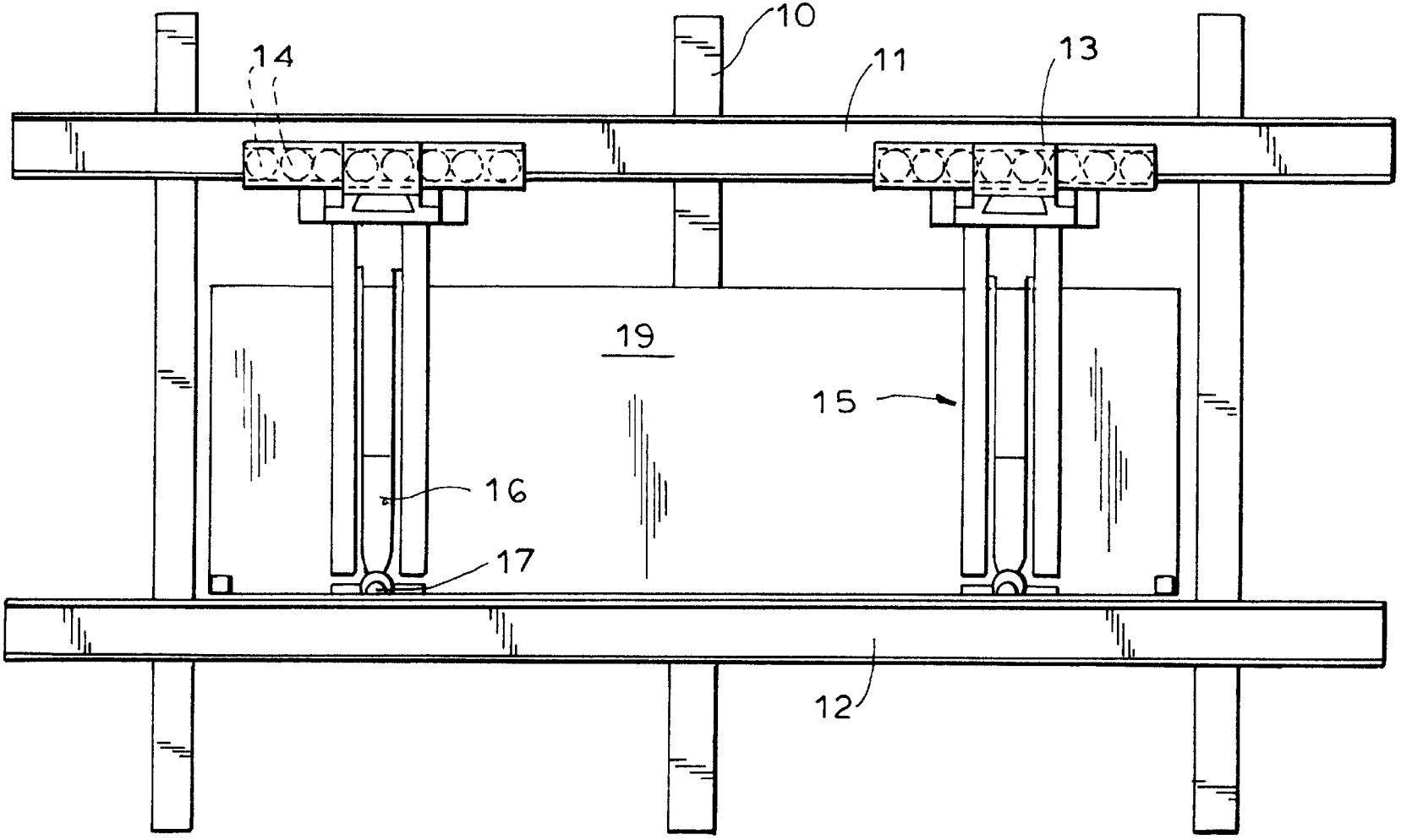
FIG. 1 is a side elevation of an embodiment of the invention in a high level shelf store.
Figure 2:
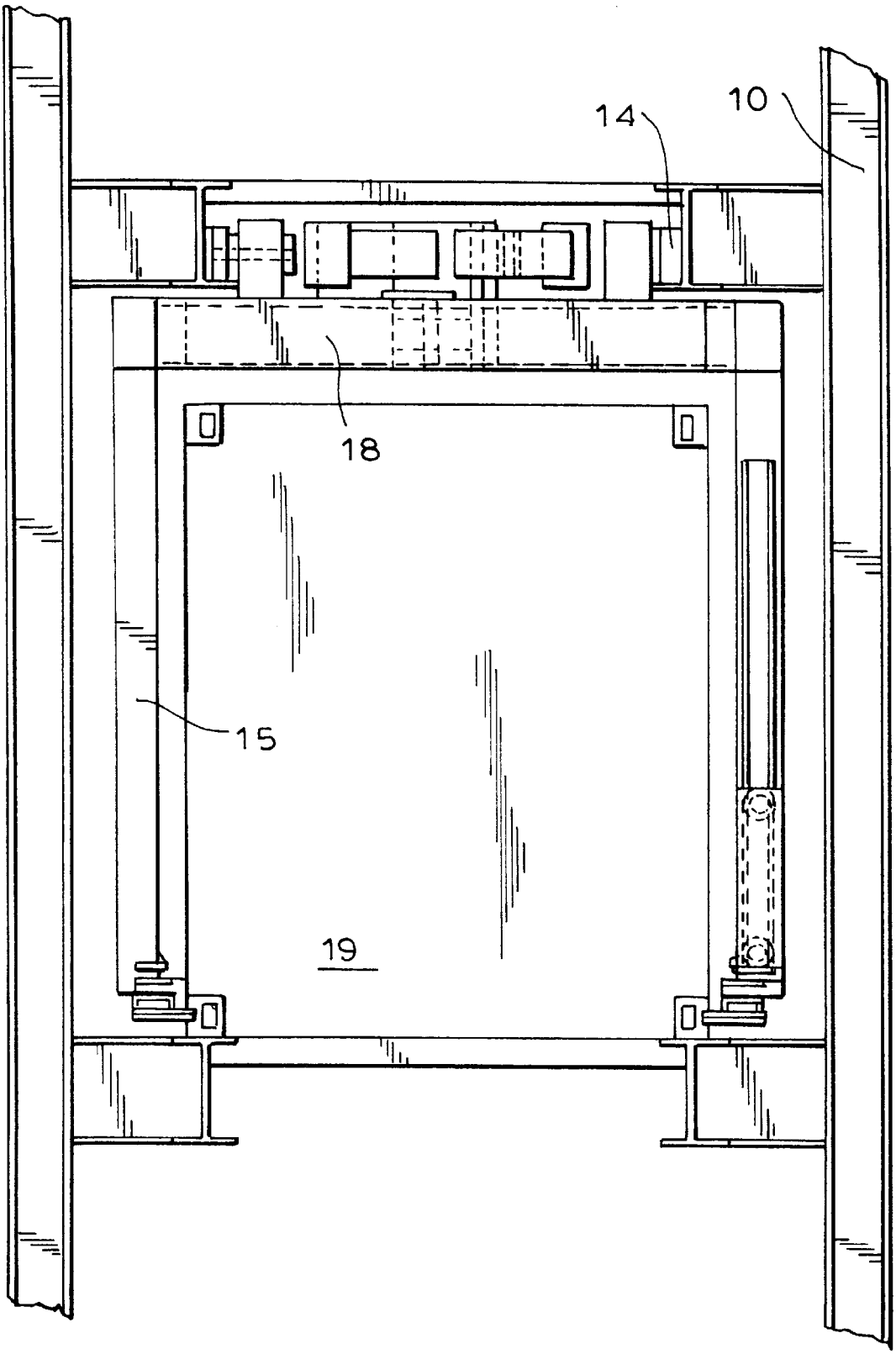
FIG. 2 is a front view of the embodiment according to FIG. 1.

The illustrated embodiment shows as part of a high level shelf store the vertical supports 10 to which spaced apart, one above the other, the respective beams 11 and 12 taking the form of double-T beams are fitted. On the lower flange track of the upper beam 11 lifting vehicles 13, equipped with running wheels 14 are adapted to travel. In the present case the lifting vehicle is formed of two dentrically constructed half-carriages of which each, as apparent from FIG. 1, comprises two vertical guide columns 15 which each guide vertical lifting elements 16 fitted at their lower ends with gripping elements 17. The mutual spacing of two guide columns 15 (see FIG. 1) which in the travelling direction are one behind the other as well as the mutual spacing of two opposite guide columns 15 (see FIG. 2) is adjustable, in the latter case by way of a transverse beam 18 or an appropriate telescopic unit. The lifting elements on each side of a transcontainer 19 to be picked up can, if required, be driven separately.

Figure 3:
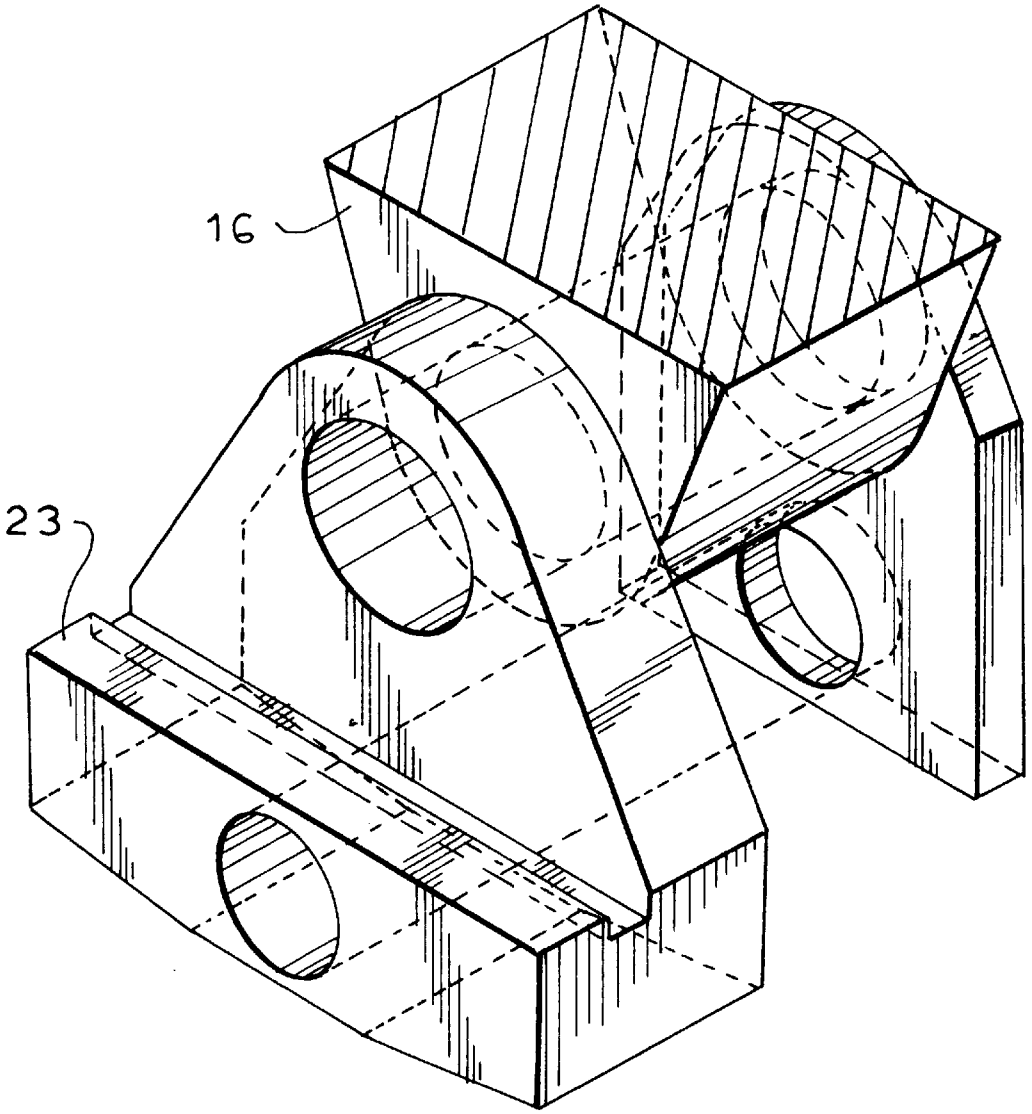
FIG. 3 is a perspective view of the U-shaped attachment element.
Figure 3B:
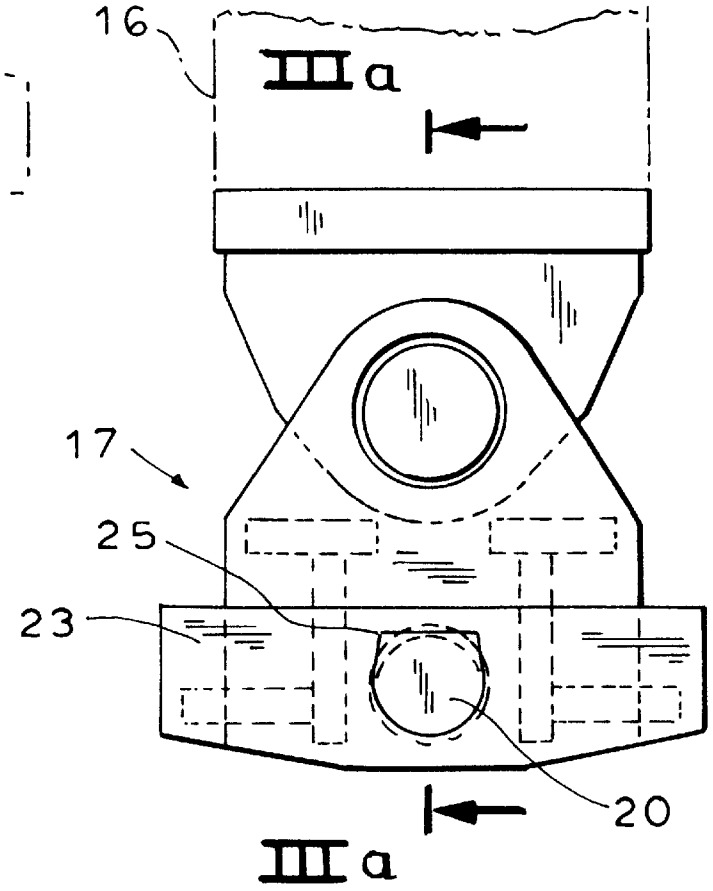
FIG. 3*b* is a attachment element in side elevation viewed along III*b*—III*b* according to FIG. 3*a*.
Figure 3A:
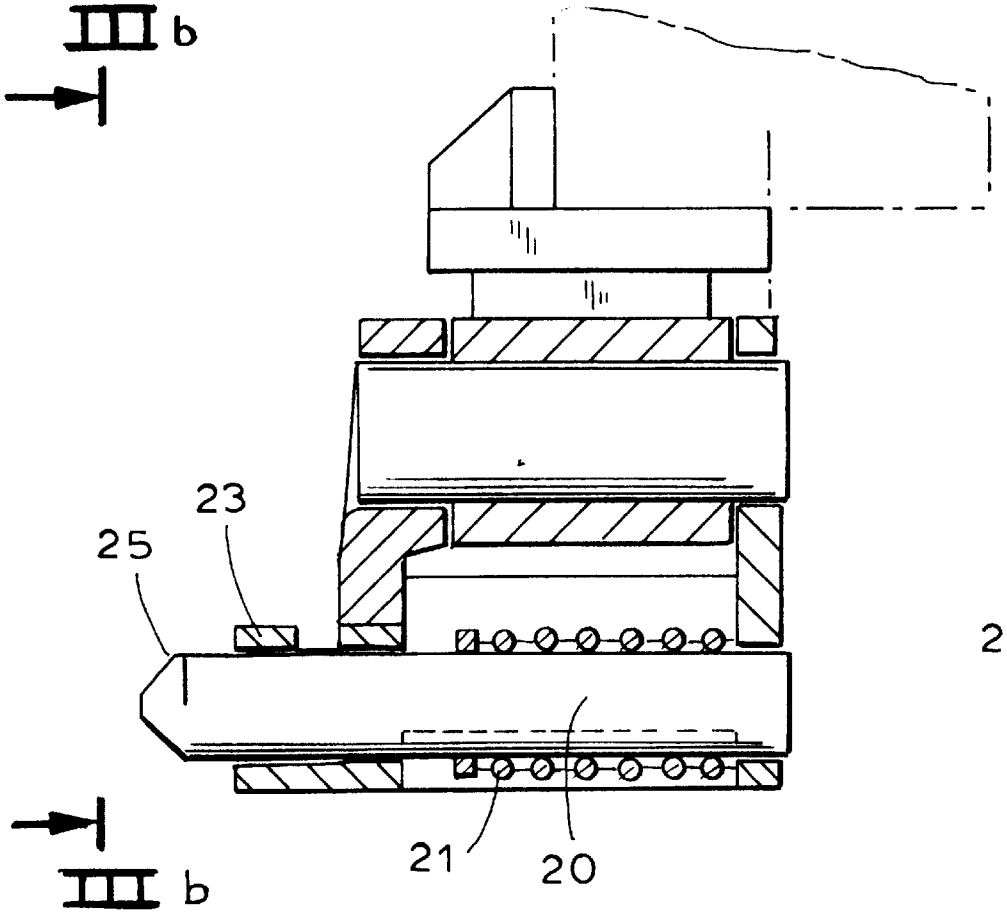
FIG. 3*a* is a attachment element in section along line III*a*—III*a* in FIG. 3*b*.
Figure 3D:
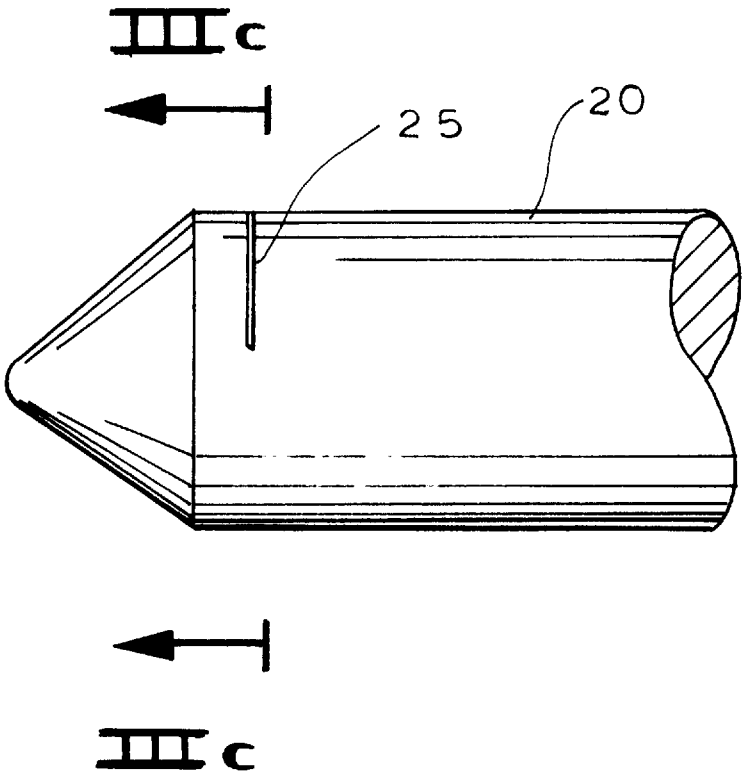
FIG. 3*d* is a side elevational view of the pin shown in FIG. 3*c*.
Figure 3C:
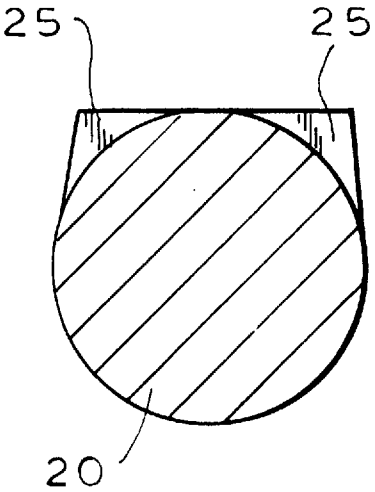
FIG. 3*c* is a cross sectional view taken along the line III*c*—III*c* of FIG. 3*d* showing a section.
Figure 5:
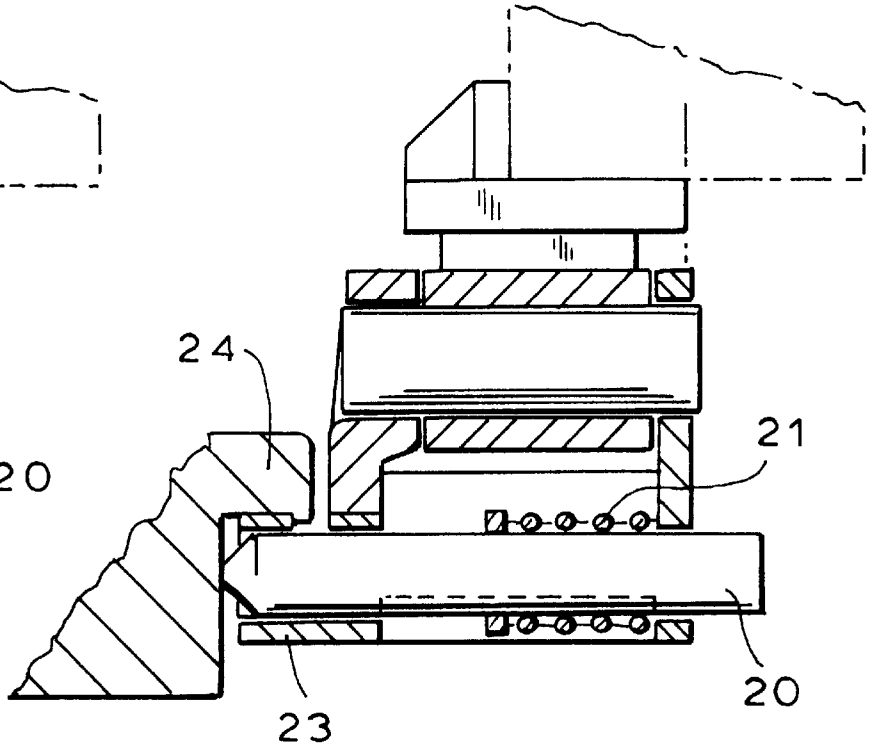
FIG. 5 is a sectional view of an attachment element including a picked up interchangeable container or semi-trailer.
Figure 4:
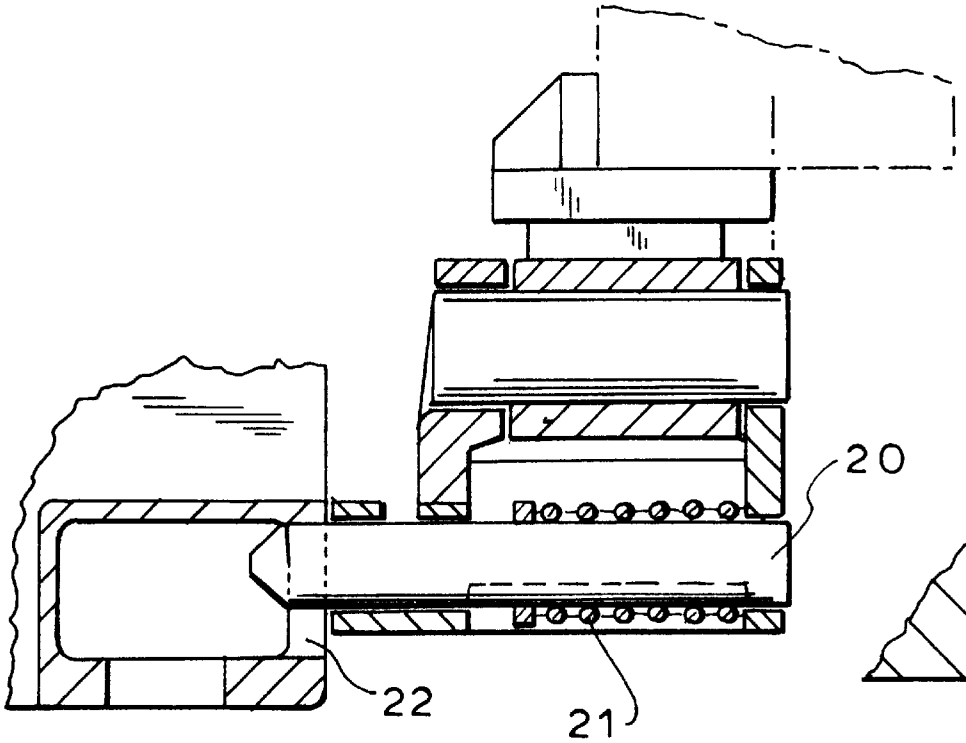
FIG. 4 is a sectional view of an attachment element including a picked up container.

The attachment element 17 according to FIG. 3 and FIGS. 3*a* and 3*b* is fitted to the lifting element 16 and comprises a U-shaped claw 23 for gripping recesses of interchangeable containers or semi-trailers. The attachment element 17 furthermore comprises a bolt 20 slidable in the direction of its longitudinal axis and secured irrotationally, which by way of a spring 21 in the unloaded condition is kept in the extended position (normal position) and which is adapted to be inserted into the elongate apertures of the load suspension points of containers. The relative position of the attachment element 17 in relation to a picked up container is apparent from FIG. 4 and that in relation to a picked up semi-trailer from FIG. 5. In the case of the container, the bolts 20 are inserted into the elongate holes 22 of the load suspension points of the container. Preferably the bolt may at its front end be equipped with one or two projections 25 shown in FIG. 3*b* which prevent sliding off, in that they grip behind the elongate holes when being lifted. If instead of the container an interchangeable container or a semi-trailer is to be picked up the claw 23 is used as illustrated in FIG. 5. Initially the bolt 20 enters into contact with the interchangeable container or semi-trailer and is caused to be pushed back against the force of the spring 21. The claw 23 grips into a matching rebate of the gripping recess 24 of the interchangeable container or semi-trailer.

The apparatus according to the invention operates as follows:

First the guide columns 15 by moving the carriages 13, on the beams 11 are so positioned that the attachment elements 17 are placed exactly opposite the load suspension points, i.e. the elongate holes 22 or gripping recesses 24. In the event that the transcontainer 19 is not in a horizontal position the individual attachment elements 17 can be brought to the desired level in relation to the load suspension points by separate control of the lifting elements 16. Thereafter the mutually opposite guide columns 15 are moved by means of the telescope units in the transverse beams 18 towards one another until either the bolts 20 project into the elongate holes of the container or the claws 23 after pushing back of the bolts 20 are brought into matching engagement with the gripping recesses. Finally the lifting elements 16 are controlled synchronously to lift the transcontainer 19 in such a manner that when lifting a container the projections 25 grip behind the elongate holes 22 or when lifting an interchangeable container or semi-trailer, the claw 23 grips into the rebate of the gripping recess 24.

If the above described apparatus forms part of a high level shelf store the container 19 is lifted only sufficiently in order, when horizontally transported, to have sufficient freedom of movement in relation to the upper flange of the beam 12 (or the floor). The lifting vehicle composed of two half-carriages is moved into the desired position by synchronous operation of all wheel drive means with the container 19 suspended, whereafter the lifting means 15 are lowered once again until the container 19 has been deposited.

Due to the drive means of the half-carriages 13 being separately controlled, they can easily be positioned to match the size of the container 19 to be moved and the spacing of the recesses respectively load suspension points (elongate holes 22). This installation obviates the normally conventional telescope means whereby considerable weight can be saved and the structural height can be minimised.

We claim:

1. A cable-suspension-free transcontainer transport apparatus comprising:

a fixed rigid horizontal beam having a lower flange;

a pair of lifting vehicles displaceable on said beam, each of said lifting vehicles being provided with:

a respective wheeled carriage riding directly on said lower flange in a travel direction, the carriages being shiftable jointly along said beam and being shiftable independently of one another along said beam to adjust a spacing between said wheeled carriages, a respective support extending horizontally transverse to said beam and secured on one of said wheeled carriages, a pair of vertical guide columns extending downwardly from each of said supports and fixed thereto at respective upper ends of said guide columns, said supports being adjustable in a direction transverse to said travel direction to vary a spacing between the guide columns of the respective lifting vehicle, and a respective vertically elongated lifting element on each of said guide columns and guided thereon for vertical movement, said lifting elements having free lower ends and being displaceable independently of one another and lineary along respective guide columns to adjust engagement of said lifting elements with a transcontainer to be transported; and attachment elements shaped to positively engage in respective formations in the transcontainer to be transported and provided at each of said lower ends of said lifting elements for engagement with said container and lifting and lowering thereof without sway, each of said adjustable supports of the respective lifting vehicle being a telescoping beam having respective two elongated parts telescopingly connected with one another and provided with respective means for elongating and contracting the telescoping beam, each of said attachment elements comprising a generally U-shaped claw pivotally connected to the respective lifting element and having a spring-loaded pin projecting therefrom parallel to said horizontal beam and a gripping recess extending perpendicular to said pin and receiving a claw of the container to be transported.

2. A cable-suspension-free transcontainer transport apparatus comprising:

a fixed rigid horizontal beam having a lower flange;

a pair of lifting vehicles displaceable on said beam, each of said lifting vehicles being provided with:

a respective wheeled carriage riding directly on said lower flange in a travel direction, the carriages being shiftable jointly along said beam and being shiftable independently of one another along said beam to adjust a spacing between said wheeled carriages, a respective support extending horizontally transverse to said beam and secured on one of said wheeled carriages, a pair of vertical guide columns extending downwardly from each of said supports and fixed thereto at respective upper ends of said guide columns, said supports being adjustable in a direction transverse to said travel direction to vary a spacing between the guide columns of the respective lifting vehicle, and a respective vertically elongated lifting element on each of said guide columns and guided thereon for vertical movement, said lifting elements having free lower ends and being displaceable independently of one another and lineary along respective guide columns to adjust engagement of said lifting elements with a transcontainer to be transported; and attachment elements shaped to positively engage in respective formations in the transcontainer to be transported and provided at each of said lower ends of said lifting elements for engagement with said container and lifting and lowering thereof without sway, each of said attachment elements comprising a generally U-shaped claw pivotally connected to the respective lifting element and having a spring-loaded pin projecting therefrom parallel to said horizontal beam and a gripping recess extending perpendicular to said pin and receiving a claw of the container to be transported.

3. The cable-suspension-free transcontainer transport apparatus defined in claim 2 wherein said pin is nonrotationally secured in said claw and is provided at an end projecting from said claw with two upwardly extending projections.

* * * * *